US005575482A

United States Patent [19]

Butler, Jr.

[11] Patent Number: 5,575,482

[45] Date of Patent: Nov. 19, 1996

[54] SPORTS BALL LAUNCHER

[76] Inventor: Bill Butler, Jr., P.O. Box 3669, Amarillo, Tex. 79106

[21] Appl. No.: 349,058

[22] Filed: Dec. 2, 1994

[51] Int. Cl.[6] ..... A63B 67/18

[52] U.S. Cl. ..... 273/411; 124/25; 124/66

[58] Field of Search ..... 273/26 D, 29 A, 273/411; 124/7, 66, 65, 17, 37, 25

[56] References Cited

U.S. PATENT DOCUMENTS

| | | | |
|---|---|---|---|
| 320,643 | 6/1885 | Engle | 124/25 |
| 3,277,878 | 10/1966 | Pankratz | 273/26 D |
| 3,670,711 | 6/1972 | Firestone | 124/25 |
| 4,254,755 | 3/1981 | Morgan et al. . | |
| 4,323,048 | 4/1982 | Saito et al. . | |
| 4,714,069 | 12/1987 | Ulrich . | |
| 5,062,646 | 11/1991 | Crist . | |
| 5,107,820 | 4/1992 | Salansky . | |
| 5,242,323 | 9/1993 | Rappaport | 124/66 |

*Primary Examiner*—Theatrice Brown
*Attorney, Agent, or Firm*—Crutsinger & Booth

[57] ABSTRACT

A volleyball launcher comprising a vertically extending tubular member, a ball cradle, a lift rod, a cross bar and a pair of ball propelling arms. The lift rod is mounted in the tubular member and is adapted for limited longitudinal travel therein. The tubular member has a pair of longitudinal slots in opposite sides thereof. The ball cradle is mounted on the upper end of the tubular member. The cross bar is mounted at its midsection to the tubular member near the upper end thereof. The outer end of each propelling arm is pivotally monted approximate a respective end of the cross bar. The inner end of each propelling arm extends through the slots under the lower end of the lift rod. An energy storing element is provided to impel the lift bar upwards. A stop member is positioned to contact the outer ends of the propelling arms, whereby during the upward travel the ball receives a launch impulse from the lift rod.

21 Claims, 3 Drawing Sheets

SPORTS BALL LAUNCHER

This invention relates to sports ball launchers and more particularly to a volleyball launcher for use by players in practice.

BACKGROUND OF INVENTION

Ball launchers are used as practice aids in many different sports including baseball, football, tennis, and volleyball and in other "ball" sports. It is important in practice to present or deliver a ball to a player under selected simulated game conditions so that he may practice responsive manipulation of the ball. It also important in practice that the ball be delivered repeatedly under the selected conditions identically each time so that the player or pupil practicing can concentrate on mastering his techniques of responding to the simulated conditions without worry about a change in those conditions.

Ball launchers for the various types of balls used in most common sports are available. In some the impulse force to launch the ball is delivered by the impact of a spring-loaded member against the ball positioned for launching. In others the ball may be placed in a catapult type mechanism for launching; in still others the ball is delivered through a tube into a space between two or more rapidly rotating wheels set at a distance from each other just slightly less than the ball diameter. Other types of launching machines operate on compressed gas and "shoot" the balls from a long tube in a manner similar to a gas operated pellet or BB gun.

Launching machines of the same types mentioned are exemplified by those of the following patents: U.S. Pat. No. 4,714,069 for a Volleyball Setting Machine by Harold C. Ulrich; U.S. Pat. No. 5,062,646 for a Volleyball Training Apparatus by Michael A. Crist; U.S. Pat. No. 5,107,820 for a Ball-Throwing Device For Tennis Balls by Werner Salansky; U.S. Pat. No. 4,254,755 for Ball Training Machine Useful In Practicing The Game of Volleyball by Steven R. Morgan et al.; U.S. Pat. No. 4,323,048 for Ball Shooting Machine For Volleyball Practice by Retsuo Saito et al.

Prior machines of the types shown in those patents may not be easily transportable, or do not impart a human-like acceleration impulse to the ball, or do not accurately repeat ball delivery characteristics or may not be easily adjustable to impart different ball delivery characteristics.

SUMMARY OF INVENTION

The present invention provides a sports ball launcher with folding members rendering the device collapsible for easy transport. The launcher is lightweight so that it is easily set up, readily movable to various positions by a single individual to produce a variety of situational ball deliveries during a single practice session. The launcher of the present invention is battery powered and thus of equal convenience for either indoor or outdoor use.

Additionally, impact mechanism imparting the launching force to the ball although set or cocked by electric motors is spring-powered so that any differences in battery charge condition or motor speed differences due to heat, lubrication deficiencies, or operative condition of the motor do not affect ball launch and flight characteristics produced by the launcher. Additionally, the impact mechanism of the present invention delivers a more human-like impetus to launch the ball in that a lift rod impacts the ball for added acceleration after the initial acceleration impulse to the ball.

BRIEF DESCRIPTION OF THE DRAWINGS

These and other objects and advantages of the present invention will become apparent from the following detailed description when read with reference to the accompanying drawings wherein.

DETAILED DESCRIPTION OF THE INVENTION

Figure 3:
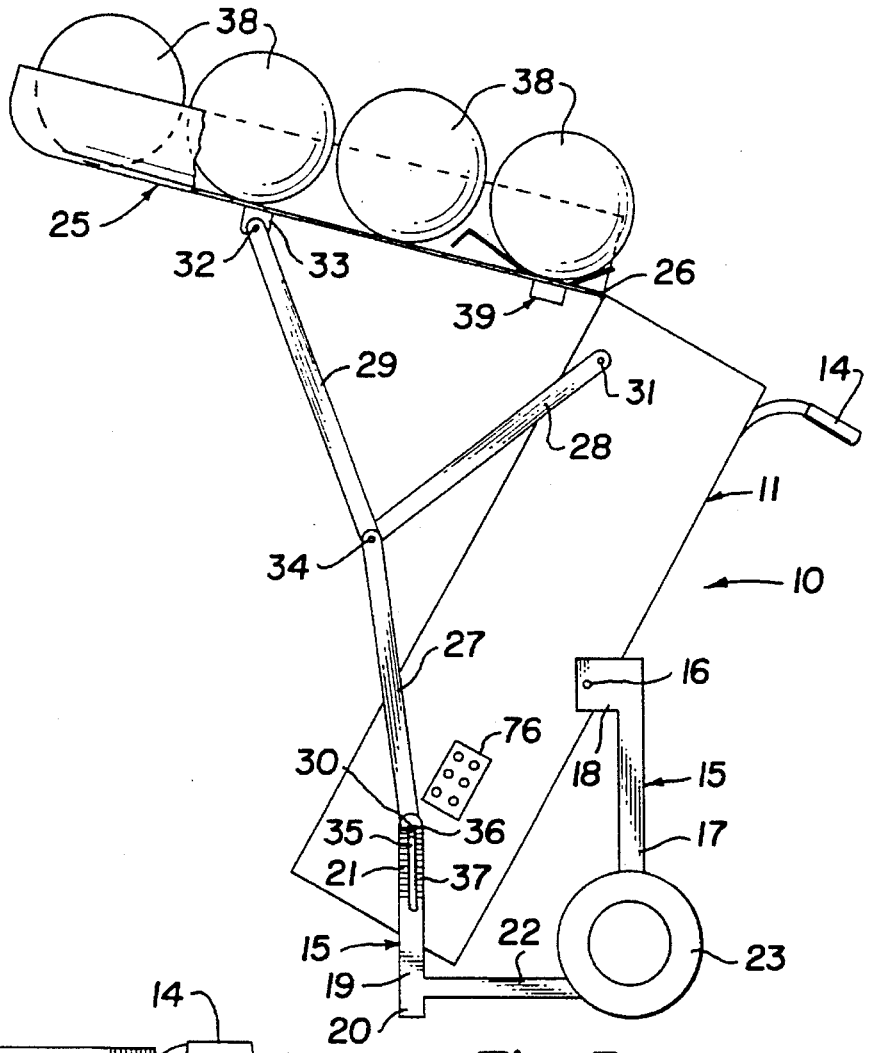
FIG. 3 is a side elevation view of the launcher of the present invention unfolded and erected to its "operational" position.
Figure 1:
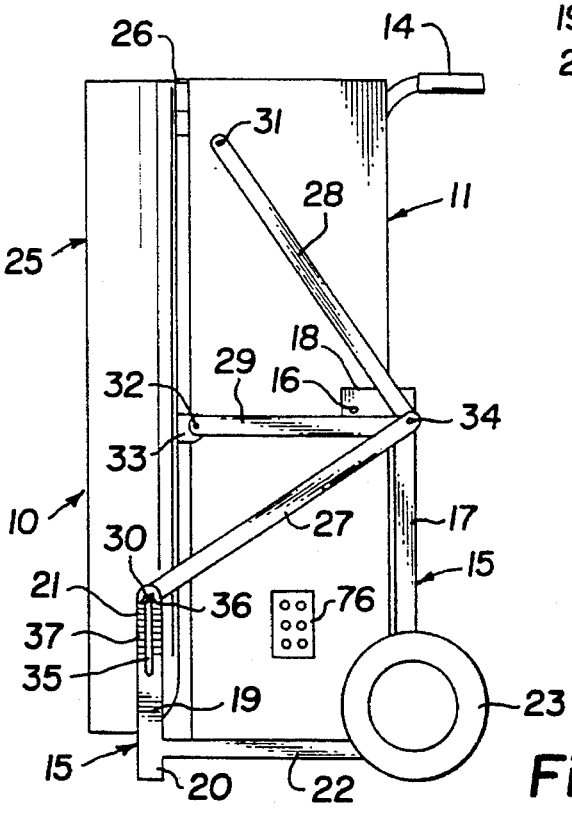
FIG. 1 is a side elevation view of the launcher if the present invention folded into its "transport" position.
Figure 2:
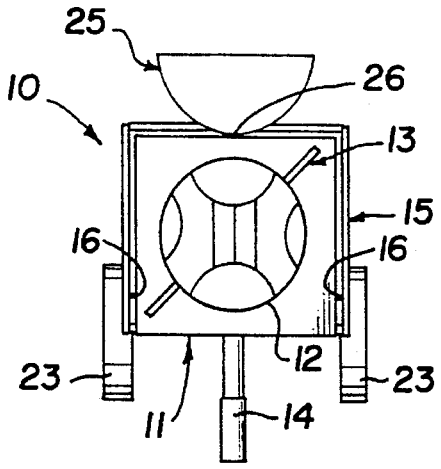
FIG. 2 is a front elevation view of the folded launcher of FIG. 1.

With reference now to the figures, there is shown in FIG. 1 a side elevation and in FIG. 2 a front end elevation of the volleyball launcher 10 of the present invention in its folded or closed condition ready for transport. FIG. 3 shows a side elevation view of the launcher in its unfolded condition ready for use. The launcher 10 comprises a housing 11 open at its upper or front end which may be of sheet metal such as aluminum or other suitable material enclosing launch impulse mechanism 13 to be described in more detail subsequently. The housing 11 need not fully enclose the launch mechanism 13 and in fact may comprise a support framework.

Attached to the upper or front end of the housing 11 is a handle 14 of appropriate formed metal such as tubular aluminum. The housing is pivotally attached to a frame member 15 at points 16 on each side thereof. Each side of frame 15 comprises a first upright member 17 with support arm 18 to which housing 11 is attached, a second upright member 19 providing a support foot 20 and pivot arm anchor 21 and cross brace 22 connected between the lower portions of the first and second uprights. Cross members not shown connect the two sides of the frame 15 together between the members 17 and 19. A pair of wheels 23 are appropriately positioned on frame 15 to provide a steady stand with feet 20 when the frame is in the operational position and to provide a wheeled transport when the frame is tilted.

A ball feed trough or shoot 25 is attached by hinge at one of its ends 26 to the upper end of housing 11. Pivotal support arms 27, 28, and 29 are each connected at one of their ends to pivot pins 30, 31, and 32 respectively on anchor 21, housing 11 and trough bracket 33 respectively. The opposite ends of support arms 27, 28, and 29 are each connected to a "central" pivot pin 34. A corresponding arrangement of support arms, pivot pins, and brackets on the other side of the launcher 10 is not shown in FIGS. 1 and 3.

Thus in unfolding the launcher 10 from a storage/transport position as shown in FIGS. 1 and 2 to its operational position as shown in FIG. 3 the housing 11 is tilted forward (to the right in FIGS. 1 and 3) about pivot point 16 and then moving pivot pin 34 and the ends of support arms 27, 28, and 29 to the left past the "center" point where arms 27 and 28 are aligned to the position shown in FIG. 3 with ball trough 25 in the feed position and the launcher angled to properly launch balls. Any of several well-known means such as rachet latches, thumbscrew clamps, or others may be used to lock the support arms and thus the launcher in the desired position.

Figure 4:
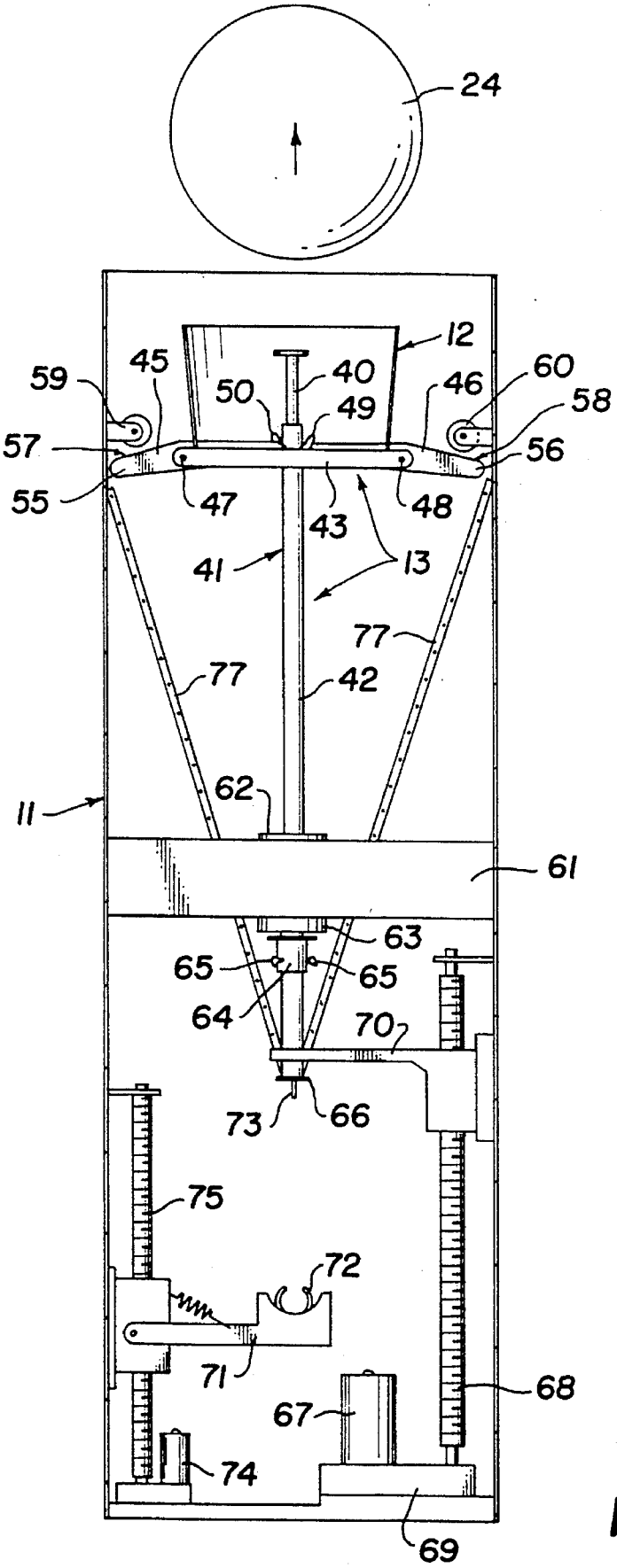
FIG. 4 is a sectional partial side elevation of the launcher of the present invention with the side wall of the housing cut away to show the impact mechanism in its uncocked position.
Figure 5:
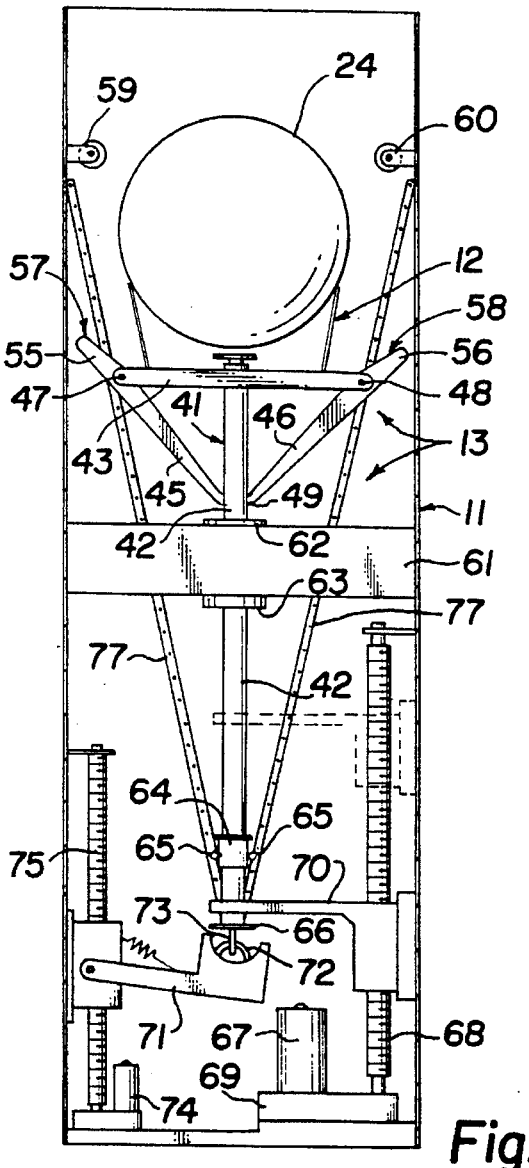
FIG. 5 is a view similar to FIG. 4 showing the impact mechanism in its loaded or cocked position.
Figure 6:
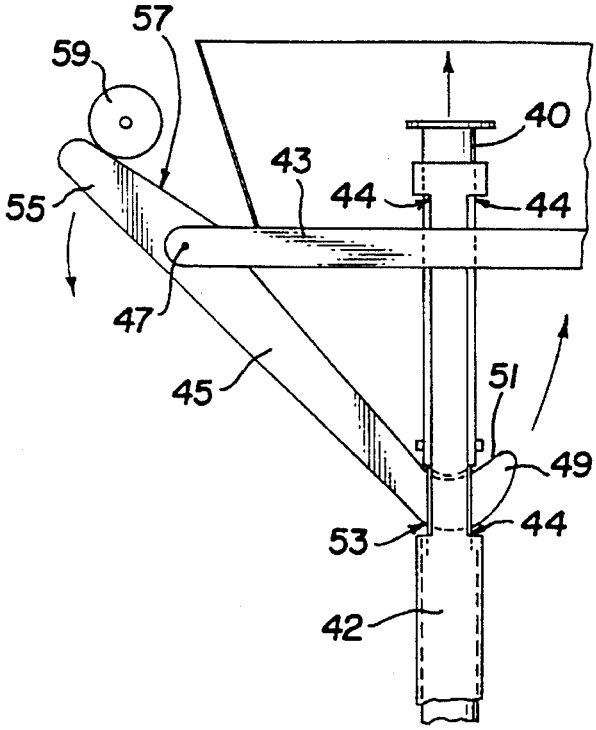
FIG. 6 is a detailed partial side elevation showing parts of the lift bar mechanism.

Reference is now made to FIGS. 4, 5, and 6 which illustrate in mechanical schematic the impulse mechanism 13 situated in housing 11. FIG. 4 shows the impact mechanism in the uncocked or unloaded condition while FIG. 5 shows the mechanism in the "cocked" position ready to launch a ball.

The mechanism 13 comprises a ball receptacle in the form of a cradle or tub 12 having a circular shape similar to a pail or washtub with inclined walls. It is of a size to support a volleyball 24 as illustrated Receptacle 12 is open at its bottom to allow lift rod 40 to impact a ball therein. Alternatively, cradle 12 may take the form of a wire cage-like structure.

Receptacle 12 is mounted on the upper end of a lift bar 41 comprising a tubular member 42 having a crossbar 43 affixed to it near its upper end as shown. Tubular member 42 has a pair of slots 44, one on each of opposite sides which extend a point near and preferably slightly above the attachment area of crossbar 43 as best shown in FIG. 6. Slideably positioned inside of tubular member 42 is lift rod 40. A pair of propelling arms 45 and 46 are pivotally attached to crossbar 43 one near each end as shown. The attaching pivots 47 and 48 of propelling arms 45 and 46 respectively are off set from the centers of the arms preferably about midway between the center of the arm and its upper or outer end. The lower ends 49 and 50 of the propelling arms 45 and 46 are formed in hook-like structures that extend through slots 44 under the lower end of lift rod 40. The hook-like structures 49 and 50 provide upper concave bearing surfaces 51 and 52 and lower convex bearing surfaces 53 and 54 respectively on the arms 45 and 46. The upper ends 55 and 56 of arms 45 46 feature bearing surfaces 57 and 58 respectively.

Affixed to and extending inwardly from each side of the housing 11 are actuator roller stops 59 and 60 positioned to contact the upper ends 55 and 56 of arms 45 and 46 when lift bar 41 approaches the end of its upward travel.

A crossmember 61 attached to housing 11 supports an alignment bearing 62 to guide the travel of lift bar 41. Attached to the underside of crossmember 61 is an elastic stop cushion or bumper 63. Toward its lower end lift bar member 42 is equipped with a limit collar 64 preferably adjustable in position along the length of member 42 such as by thumbscrews 65. At the lower end of member 42 is attached a collar or flange 66 used to move lift bar 41 to its loaded position as will be explained subsequently.

Elastic propulsion bands 77, preferably two or more in number, are attached by appropriate means between the lower end of lift bar 41 below collar 64 and the housing 11 at points above crossmember 61.

Secured in the lower portion of housing 11 is a loading or cocking motor 67 operated by an electric storage battery (not shown) or other suitable source. Motor 67 is used to pull lift bar 41 down to its loaded or cocked position as shown in FIG. 5. Loading may, for example, be accomplished by a motor 67 driving leadscrew 68 through gearbox 69 to pull loading arm 70 geared to leadscrew 68 and bearing against the top of flange 66 down to the position shown in FIG. 5.

Lift bar 41 is held in the loaded or cocked position by trigger arm 71 bearing spring-loaded latchhook 72 attached to latch ring 73. Trigger arm 71 is vertically adjustable to vary the launch power applied to lift bar 41 by elastic bands 77 when latchhook 72 is released. The vertical adjustment may be by an electric motor 74—leadscrew 75 arrangement similar to that of the loading mechanism or by other suitable mechanism.

In operation of the device of the present invention the launcher may be moved by hand from a transport vehicle or from its storage facility in its closed or folded condition as shown in FIG. 1 in a manner similar to any conventional "tilt and roll" two-wheel hand cart. When situated at the desired launch spot, the frame 15 is placed in an upright position as shown and the unit unfolded to the position shown in FIG. 3. by tilting the housing 11 forward about pivot point 16 while pushing pivots 34 of supports arms 27, 28, and 29 rearward until arms 27 and 28 go "over center." Housing 11 is then allowed to tilt back to position the various elements of the launcher in the launch position shown in FIG. 3. The angle of launch may be adjusted by movement of pivot points 30 up or down in slots 35 provided in pivot arm anchor 21. The pivot points may be clamped into the desired position by a thumbscrew 36 or other suitable means in a well-known manner. A positioning scale 37 may be etched into or otherwise applied to the anchor arm 21 along slot 35 to assist in setting or resetting the housing tilt to a particular desired position.

A supply of balls 38 to be launched is then loaded into feed shoot 25. The balls are gravity fed through a spring-loaded gate 39 into the launcher one at a time. Gate 39 is actuated by the beginning of the launch cycle as described hereinafter.

The launch cycle is initiated by activation of a motor sequence controller 76 which may be of any suitable type well-known in the art. The launch sequence begins by application of power to the loading motor 67 to turn leadscrew 68 and move loading arm 70 down the leadscrew.

As loading arm 70 moves down it contacts collar 66 and pulls lift bar 41 down stretching propulsion bands 77. The loading arm 70 continues to move downward until spring-loaded latchhook 72 engages and closes through latch ring 73 whereupon motor 67 is reversed to move the loading arm back to its "ready" position as shown by dash lines in FIG. 5.

Depending on the setting of motor sequence controller 76 the launch mechanism will be either automatically or manually fired to launch a ball. The motor sequence controller may be adapted to automatically sequentially launch a pre-set number of balls or to launch balls by manual trigger only. Subsequent to each ball launch, ball gate 39 is triggered to allow the next ball and trough 25 to be loaded into the launcher in a manner well-known.

The launch mechanism of the present invention provides impetus to launch balls in a new and unique manner. As the launcher is triggered and the lift bar 41 released by the opening of latchhook 72, the elastic propulsion bands 77 accelerate the lift bar 41 including the receptacle 12 and the volleyball 24 situated therein rapidly upward. This acceleration of the lift bar 41 and ball 24 is continued until the lift bar 41 reaches a position at which the ends of propelling arms 45 and 46 contact the actuator roller stops 59 and 60. Continued upward movement of the lift bar causes the upper ends of arms 45 and 46 to be pushed rapidly downward relative to the lift bar 41 by stops 59 and 60 and thus rotated about their pivot points 47 and 48. The opposite ends of arms 45 and 46 are thus forced upward relative to lift bar 41 with even greater acceleration because of the lever action resulting from the offset pivot points 47 and 48. Lift rod 40 riding on top of arms 45 and 46 projecting through slots 35 is thus propelled by arms 45 and 46 into the ball 24 being launched to give it added impetus just at the end of the launch sequence. This added impetus provides a ball flight more nearly resembling the event produced by human impetus than with other types of ball launchers.

Figure 7:
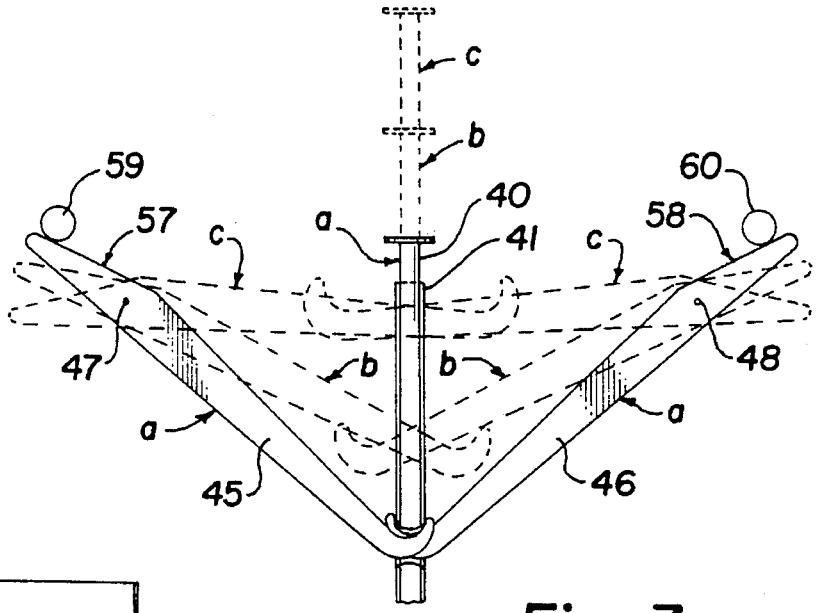
FIG. 7 is a diagram illustrating how the propelling arms provide increasing acceleration to the ball as it is launched.

FIG. 7 is a diagram illustrating how the shape of the propelling arms 45 and 46 produce a progressive acceleration of the lift rod 40. Illustrated in FIG. 7 and the relative positions of lift rod 40 and propelling arms 45 and 46 at (a) the moment of contact between the upper bearing surfaces 57 and 58 with the actuator roller stops 59 and 60 respectively shown in solid lines, (b) the relative positions after a first unit of upward travel of the lift bar 41 shown in dark-dot lines, and (c) their relative positions after a second like unit of upward travel of the lift bar 41 shown in dashed lines. As illustrated, although the relative movement between the actuating roller stops 59 and 60 and the lift bar 41 (as represented by the pivot points 47 and 48) are shown to be in equal increments, the movement of the lift rod 40 is increased during the second increment of movement than during the first increment thus producing an increasing acceleration of the lift rod 40 and the volleyball it is propelling.

Of course various other forms of mechanical stored energy devices, such as metal coil springs, may be used in place of bands 77 to power the impulse launch mechanism of the present invention. Further other means than the electric motor/drive screw mechanisms shown may be used to cock or load the launcher and adjust the launch power.

Thus there had been disclosed a specific embodiment of the ball launcher of the present invention. Because many changes, modifications, and additions, still within the spirit of the invention, will occur to others familiar in this field this invention is to be limited only as set forth in the following claims:

What is claimed is:

1. A volleyball launched for training players comprising:

a support housing (11) having an upper end; and an launch mechanism (13) in said housing, said launch mechanism comprising: upwardly extending lift bar assembly (41), mechanical stored energy propelling means (77) and a pair of stop means; (59,60);

said lift bar assembly having an upper end and comprising a tubular member (42) having an upper end, a ball cradle (12), a lift rod (40), a cross bar (43), and a pair of propelling arms (45, 46);

said lift bar assembly being mounted in said housing and adapted for limited longitudinal travel therein; said tubular member extending downwardly for a substantial distance from said upper end of said lift bar assembly, and having a pair of longitudinal slots in opposite sides thereof extending along said tubular member from near said upper end of said tubular member;

said ball cradle being mounted on the upper end of said tubular member and adapted to receive a ball to be launched;

said lift rod having a lower end and being adapted for travel along and within said tubular member between an upward limit and a downward limit, said lift rod extending substantially into said ball cradle at the upward limit of travel;

said cross bar being mounted at its midsection to said tubular member near the upper end thereof and extending laterally in opposite directions and terminating within said housing;

said propelling arms each having an inner and an outer end and said outer end being pivotally mounted proximate a respective end of said cross bar, said inner end of said propelling arm extending inwardly through said slots under the lower end of said lift rod;

said stored energy propelling means being connected between said support housing and said lift bar assembly and adapted to impel said lift bar assembly through said limited travel toward said upper end of said support housing;

said stop means being affixed to said support housing near said upper end thereof and being adapted and positioned to contact said outer ends of said propelling arms when said lift bar assembly approaches the limit of its travel toward said upper end whereby during the upward travel of lift bar assembly said ball receives a launch impulse from said ball cradle and an added launch impulse from said lift rod.

2. The launcher as defined in claim 1 wherein said stored energy propelling means comprises at least one elastic band stretched between said housing and said lift bar.

3. The launcher as defined in claim 2 wherein the propulsive force applied to launch said ball is variable by adjustment of the limit of travel of said lift bar.

4. The launcher as defined in claim 3 wherein adjustment of the limit of travel of said lift bar is by adjustment of the launch start position of said lift bar.

5. The launcher as defined in claim 2 further comprising a base frame with said support housing pivotally mounted thereon and adapted to provide an adjustable vertical angle of launch.

6. The launcher as defined in claim 1 wherein the inwardly extending opposite ends of said propelling arms terminate in a concave surface under the lower end of said lift rod.

7. The launcher as defined in claim 6 further comprising a ball feed means adapted to deliver single balls sequentially to said ball cradle in preparation for launch.

8. The launcher as defined in claim 1 further comprising a base frame with said support housing pivotally mounted thereon and adapted to provide an adjustable vertical angle of launch.

9. The launcher as defined in claim 8 further comprising a ball feed means adapted to deliver single balls sequentially to said ball cradle in preparation for launch.

10. The launcher as defined in claim 3 wherein said base frame is mounted on at least two wheels and adapted to be easily trans-located by one person.

11. The launcher as defined in claim 1 further comprising a ball feed means adapted to deliver single balls sequentially to said ball cradle in preparation for launch.

12. The launcher as defined in claim 1 wherein the inwardly extending inner end of said propelling arms terminate in a concave surface under the lower end of said lift rod.

13. The launcher as defined in claim 12 further comprising a base frame with said support housing pivotally mounted thereon and adapted to provide an adjustable vertical angle of launch.

14. The launcher as defined in claim 13 wherein the propulsive force applied to launch said ball is variable by adjustment of the limit of travel of said lift bar.

15. The launcher as defined in claim 13 wherein said base frame is mounted on at least two wheels and adapted to be easily trans-located by one person.

16. The launcher as defined in claim 12 further comprising a ball feed means adapted to deliver single balls sequentially to said ball cradle in preparation for launch.

17. The launcher as defined in claim 1 wherein said stored energy propelling means comprises at least one metal spring means stretched between said housing and said lift bar.

18. The launcher as defined in claim 17 further comprising a base frame with said support housing pivotally mounted thereon and adapted to provide an adjustable vertical angle of launch.

19. The launcher as defined in claim 18 wherein the inwardly extending inner end of said propelling arms terminate in a concave surface under the lower end of said lift rod.

20. The launcher as defined in claim 19 further comprising a ball feed means adapted to deliver single balls sequentially to said ball cradle in preparation for launch.

21. The launcher as defined in claim 20 wherein said base frame is mounted on at least two wheels and adapted to be easily trans-located by one person.

* * * * *